United States Patent [19]

Ono

[11] Patent Number: 4,563,837

[45] Date of Patent: Jan. 14, 1986

[54] ULTRA-PRECISION GRINDING MACHINE

[75] Inventor: Yoshihiko Ono, Machida, Japan

[73] Assignee: Tokiwa Seiki Industrial Company, Limited, Kanagawa, Japan

[21] Appl. No.: 478,324

[22] Filed: Mar. 24, 1983

[30] Foreign Application Priority Data

| | | | |
|---|---|---|---|
| Jun. 14, 1982 | [JP] | Japan | 57-100763 |
| Jun. 14, 1982 | [JP] | Japan | 57-100764 |
| Jun. 28, 1982 | [JP] | Japan | 57-109844 |
| Jul. 2, 1982 | [JP] | Japan | 57-114064 |
| Jul. 24, 1982 | [JP] | Japan | 57-128347 |

[51] Int. Cl.[4] ..... B24B 5/08

[52] U.S. Cl. ..... 51/34 R; 51/240 T

[58] Field of Search ..... 51/34 R, 34 K, 34 H, 51/105 EC, 165.93, 131.2, 290, 227 R, 240 T, 90; 269/73

[56] References Cited

U.S. PATENT DOCUMENTS

| | | | |
|---|---|---|---|
| 1,198,612 | 9/1916 | Bright | 51/165.93 |
| 2,960,806 | 11/1960 | Kunzler | 51/240 R |
| 3,124,018 | 3/1964 | Gough | 51/240 R |
| 3,289,356 | 12/1966 | Hunt et al. | 51/227 R |
| 3,552,069 | 1/1971 | Butler | 51/34 R |

FOREIGN PATENT DOCUMENTS

| | | | |
|---|---|---|---|
| 1806320 | 5/1970 | Fed. Rep. of Germany | 51/34 H |
| 2440123 | 3/1975 | Fed. Rep. of Germany | 51/105 EC |

*Primary Examiner*—James L. Jones, Jr.
*Assistant Examiner*—Robert A. Rose
*Attorney, Agent, or Firm*—Thomas & Kennedy

[57] ABSTRACT

An ultra-precision grinding machine for finishing the work portion of the workpiece very accurately is disclosed, in which a Y-table which can freely move in the Y-axis direction is mounted on an X table which can freely move in the X-axis direction on a base plate, and a slide table for supporting the workpiece is mounted on this Y table so that it can freely move in any horizontal directions and freely revolve. The grinding tool adapted to be engagement with the work portion of the workpiece is supported to a machining head apparatus disposed upward of the slide table so that it can move vertically and freely micro-vibrate horizontally, and at the same time, the amplitude of the microvibration can be freely adjusted.

9 Claims, 6 Drawing Figures

ULTRA-PRECISION GRINDING MACHINE

BACKGROUND OF THE INVENTION

The present invention relates to an apparatus for finishing a workpiece ultra-precisely, and more particularly to an apparatus for finishng ultra-precisely the portion to be worked which hereinafter is referred to as a work portion. Such a work portion may be a groove, a concavity, a hole, or the like.

Generally, metal molds which have a work portion such as a complicated hole groove are worked and finished extremely accurately after they have been worked by using an electrical discharge machine. Since the precisely finished work has been conventionally performed manually by using an ultrasonic abrasion machine and so on, there are drawbacks such as being remarkably ineffective and lacking in uniformity.

Furthermore, in conventional grinding machines, where there is a slight difference in direction between the portion to be worked of the workpiece and a grinding tool of an abrasion machine and the like, the workpiece has to be ground so that the workpiece portion could be worked correctly. This is another problem of the prior art.

SUMMARY OF THE INVENTION

It is an object of the invention to provide an ultra-precision grinding machine which can efficiently perform the ultra-precise finishing by automatically correcting the mismatch even if there is a slight difference of the directions between the work portion of the workpiece and the grinding tool.

It is another object of the invention to provide an ultra-precision grinding machine which can adjust the amplitude of the grinding tool corresponding to the magnitude of the clearance between the work portion of the workpiece and the grinding tool.

It is a further object of the invention to provide an ultra-precision grinding machine which is provided with a grinding tool which can vertically and periodically move for improvement in efficiency of grinding of the work portion of the workpiece.

It is still another object of the invention to provide an ultra-precision grinding machine which can smoothly and largely move the workpiece horizontally.

Briefly described, these and other objects of the invention are accomplished by the provision of an ultra-precision grinding machine in which a grinding tool attached to a machining head apparatus disposed upwardly of a base plate can freely and precisely vibrate horizontally, and in which the workpiece having a work portion adapted to come into engagement with the grinding tool is placed on the base plate so as to freely and smoothly move in any horizontal direction. According to the invention, the grinding tool is so constructed that the amplitude thereof can be freely adjusted by means of an eccentric system; that the grinding tool can vibrate freely vertically; and that a table supporting the workpiece is disposed so as to freely and largely move in the X- and Y-axis directions.

BRIEF DESCRIPTION OF THE DRAWINGS

These and other objects, features and advantages of the present invention will be more apparent from the following description of a preferred embodiment, taken in conjunction with the accompanying drawings, in which.

DESCRIPTION OF THE PREFERRED EMBODIMENTS

Figure 1:
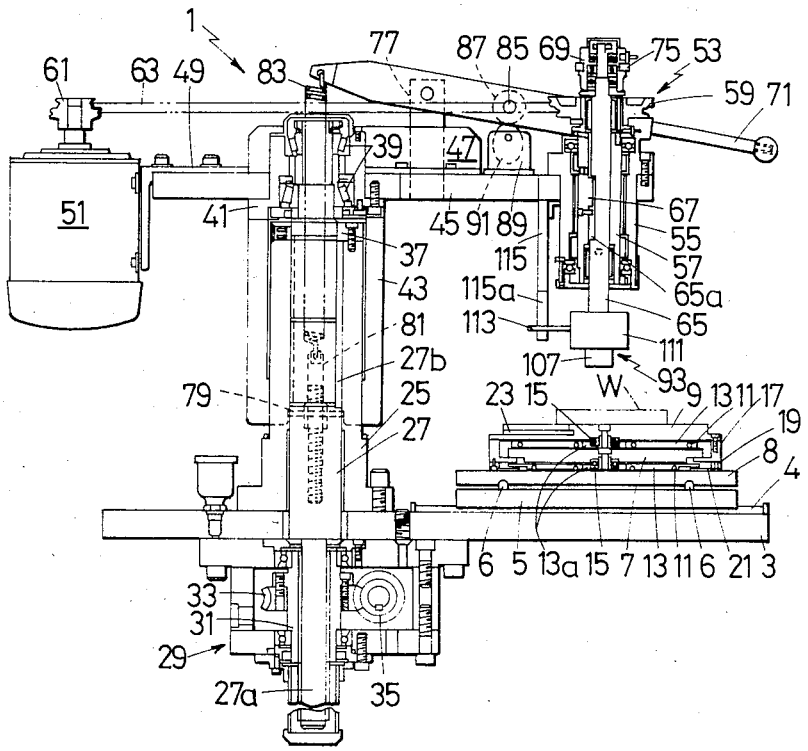
FIG. 1 is a front elevational partially sectioned view of a machine according to the present invention.

Referring to FIG. 1, a grinding machine 1 in accordance with the present invention is shown, in which a pair of guide rails 4 which extend in the X-axis direction (the right to left direction in FIG. 1) is mounted to a base plate 3 of the grinding machine 1, and an X table 5 is slidably supported on the guide rails 4. On the upper surface of the X table 5, is mounted a pair of guide rails 6 which extend in the Y-axis direction perpendicular to the direction of the movement of the X table 5. A Y table 8 is likewise slidably supported on the guide rails 6. A first discoidal slide table 7 is mounted on this Y table 8 so as to move horizontally and to rotate freely. A second discoidal slide table 9 is similarly mounted on this first slide table 7 so as to move horizontally and to rotate freely. A number of balls 11 are rollably interposed between the Y table 8 and the first slide table 7 and between the first slide table 7 and the second slide table 9 for extremely smooth movement and rotation. Each ball 11 is held with a proper interval by discoidal retainers 13. A radial bearing 15 extending in a central hole 13*a* of each retainer 13 mentioned above is rotatably supported at the central portions of the above-stated first and second slide tables 7 and 9.

When each retainer 13 comes into contact with the radial bearing 15, the movement of each of the slide tables 7 and 9 becomes difficult since each ball 11 changes from the rolling state to the sliding state. Consequently, smooth movement of each slide table is secured in the range where no radial bearing 15 contacts with each retainer 13. However, since the slide tables 7 and 9 are supported on the X and Y tables 5 and 8, it is possible to move smoothly the slide tables even in the case of largely moving them to change the work position of the workpiece material, and the positional relationship between the first and second slide tables 7 and 9 and each retainer 13 can be maintained without largely affecting their accurate location.

An annular cover 17 surrounding and enclosing the first slide table 7 and the like is fixed by bolts or the like on the bottom surface of the second slide table 9. An annular plate 21 is attached on the lower surface of this cover 17 through an annular spacer 19. Thus, the intrusion of dust or dirt into the first and second slide tables 7 and 9 is prevented. A plurality of radial T-shaped grooves 23 is formed in the upper surface of the second slide table 9. Therefore, it is possible to fix a workpiece W on the upper surface of the second slide table 9 through a fixing tool such as T bolts or the like so that the workpiece thusly fixed on the second slide table 9 can freely and smoothly move in any horizontal direction and freely rotate.

A cylindrical guide post 25 is vertically fixed near one side portion of the afore-mentioned base plate 3 by a plurality of bolts, and a supporting rod 27 is mounted in this guide post 25 so that the vertical location can be freely adjusted. A threaded portion 27*a* is formed in the lower end portion of this supporting rod 27, and sleeve nuts 31 are threadably engaged with this threaded portion 27*a*. These sleeve nuts are supported in a gear box 29 mounted on the lower surface of the base plate 3 so as only the rotate freely. A worm wheel 33 is fixed to these sleeve nuts 31 in a body and a worm gear 35 which is suitably connected to a motor and the like engages the worm wheel 33. A key member 37 fixed on the upper end portion of the above-mentioned guide post 25 engages a key groove 27*b* which is formed vertically in the body of the supporting rod 27. Therefore, proper rotation of the worm gear 35 allows the supporting rod 27 to be moved up and down.

A pipe member 41 is rotatably supported at the upper end portion of the supporting rod 27 through a plurality of bearings 39. A cover pipe 43, which slidably surrounds the guide post 25, is attached on the lower surface of this pipe member 41 in a body. Reinforcement ribs 47 are fixed along opposite edges of the upper face of the plate-like arm 45, and a rotation driving apparatus 51 such as a motor is mounted to the rear end portion through a bracket 49. A machining head apparatus 53 is mounted to the edge portion of the arm 45. Thus, the machining head apparatus 53 and the like moves vertically in a body depending upon the ascent or descent of the above-mentioned supporting rod 27.

The machining head apparatus 53 is so constructed as follows. A rotary tube 57 is supported so as only to rotate in a sleeve 55 which is fixed at the edge of the arm 45 through a plurality of bearings and a pulley 59 is attached in a body to the upper portion of this rotary tube 57. A belt 63 installed around a driving pulley 61, which is equipped to the aforementioned rotation driving apparatus 51, is installed around this pulley 59. A spindle 65 piercing vertically through the rotary tube 57 is further supported to the rotary tube 57 so that it can freely slide only axially. An axial key groove 65*a* is formed in the body of the spindle 65, and a key 67 formed on the rotary tube 57 engages this key groove 65*a*. Therefore, the spindle 65 rotates together with the rotary tube 57 in a body and can freely move solely in the axial direction.

Figure 2:
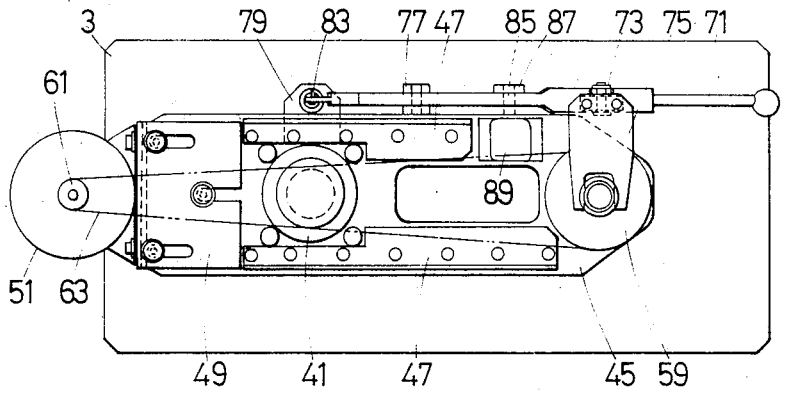
FIG. 2 is a top plan view.

A tubular cap 69 is attached to the upper end portion of the spindle 65 through a plurality of bearings so as only to rotate. A coupling plate 75, which is pivotally mounted to a swinging lever 71 through a pin 73 (refer to FIG. 2), is connected to this cap 69. The body of the above swinging lever 71 is pivotally mounted to a bracket 77 which is vertically attached to the above-mentioned arm 45. A spring member 83, such as a balance spring which serves to balance with the weight of the afore-stated machining head apparatus 53, is attached between the rear end portion of this swinging lever 71 and a threaded rod member 81, which is supported so as freely to adjust the vertical location thereof relative to a bracket 79 fixed to the above-stated guide post 25. Thus, the spindle 65 is always lifted upward by a function of the spring member 83, and it descends by operating the swinging lever 71 against the biasing force of the spring member 83. In this case, it is possible to pull the spindle 65 downward against the biasing force of the spring member 83 by suitably hanging down a plurality of weights or weights of different magnitudes (not shown) to the edge of the swinging lever 71.

A cam-follower 87 is rotatably attached through a pin 85 to a proper position of the swinging lever 71. A cam 91 rotatably contacts the lower side of this cam-follower 87. This cam 91 is connected to the output shaft of a rotation driving apparatus 89 such as a motor which is attached to the afore-mentioned arm 45. Thus, when the cam 91 rotates by the rotation driving apparatus 89, the swinging lever 71 repeats the vertical motion periodically, so the spindle 65 moves vertically in association with this. Therefore, suitable control of the rotation of the rotation driving apparatus 89 provides suitable control of the cycle or period of the vibration. It is possible to change the amplitude of the vertical motion and the location of the bottom dead point of the spindle 65 by detachably disposing either of the cam-follower 87 or the cam 91 or both of them in a conventional manner thereby coping with the variations of the thickness of the workpiece and the depth of the groove or the like of the work portion.

The mechanism for vertical moving the spindle 65 is not limited to the construction described previously. However, it is possible to interpose the cylindrical cam or the like between the pulley 59 and the sleeve 55 mentioned before, or other various constructions may be employed. The rotation driving apparatus 51 can be also used as a driving source for moving the spindle 65.

Figure 3:
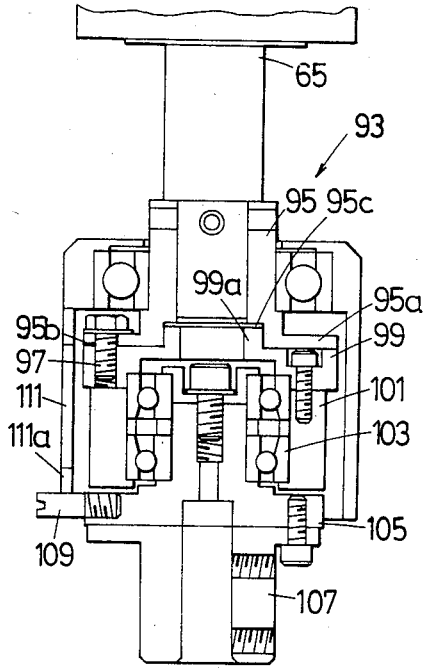
FIG. 3 is an enlarged cross sectional view of a holder.

A holder 93 is attached to the lower end portion of the spindle 65. This holder 93 serves to hold a grinding tool comprising a grindstone or an appropriate tool steel or a chuck such as a collet chuck which holds the grinding tool. The construction of this holder 93 is shown in FIG. 3. Here, a flange 95*a* is formed horizontally in the lower portion of a sleeve 95 fixed in a body to a lower end portion of the spindle 65 by using set screws and the like, and arcuate holes 95*b* are formed in a plurality of portions of this flange 95*a*. An eccentric hole 95*c* is formed in the center of the lower face of the sleeve 95 with a slight eccentricity relative to the axial center of the spindle 65. An eccentric disc 99 is attached to the lower face of the sleeve 95 through a plurality of bolts 97 piercing through the arcuate holes 95*b* so that the rotating position of the disc 99 can be freely adjusted. An eccentric height 99*a* engaged with the eccentric hole 95*c* is formed on the upper portion of this eccentric disc 99. Since eccentric disc 99 is attached with an eccentricity relative to the axial center of the spindle 65, it is possible to adjust the location of the axial center of the eccentric disc 99 relative to the axial center of the spindle 65 by suitably rotating the eccentric disc 99 after the bolts 97 have been loosened.

A bearing sleeve 101 is fixed in a body on the lower face of the eccentric disc 99 through a plurality of bolts, and a holder block 105 is rotatably supported in this bearing sleeve 101 through an eccentric bearing 103. The above eccentric bearing 103 is so constructed that the axial center of the inner hold of the inner race is slightly eccentric relative to the axial center of the eccentric disc 99. Therefore, the axial center of the holder block 105 is eccentric relative to the axial center of the eccentric disc 99. A holder machine 107 for holding the grinding tool and the like is attached in a body through a plurality of bolts to the lower face of this holder block 105. A pin 109, projecting horizontally in the radial outward direction, is fixed to the lower end portion of the holder block 105. This pin 109 engages slit 111*a* formed vertically on the lower end portion of a tubular cover 111 which is supported roatably to the sleever 95 through a bearing. The above cover 111 is also formed with a protruding pin 113 (refer to FIG. 1) projecting horizontally, and this protruding pin 113 engages a vertical slit 115*a* of a bracket 115 which depends from the previously mentioned arm 45. Consequently, the rotation of the cover 111 and the holder block 105 around the spindle 65 and the like is restricted.

In the above construction, assuming that the axial centers of the spindle 65, the eccentric disc 99, and the holder block 105 are designated by letters O, P and Q, respectively, the interval between the axial centers O and Q is adjusted by adjusting the location of the eccentric disc 99 relative to the spindle 65, so that it is possible to adjust the radius (amplitude of the microvibration) of the eccentric rotation of the holder block 105 upon rotation of the spindle 65.

In operation, a workpiece W is fixed on the second slide table 9; a work tool corresponding to the work portion such as a hole or the like of the workpiece is installed to the holder 93. The work tool is brought into engagement with the work portion of the workpiece by operating the swinging lever 71 and at the same time a lapping agent is supplied therein, as required. The spindle 65 is rotated by the rotation driving apparatus 51 and then the rotation driving apparatus 89 is rotated. The work tool starts the rotation (microvibration) with a radius equivalent to a micro-eccentric amount and at the same time it moves vertically.

Figure 4:
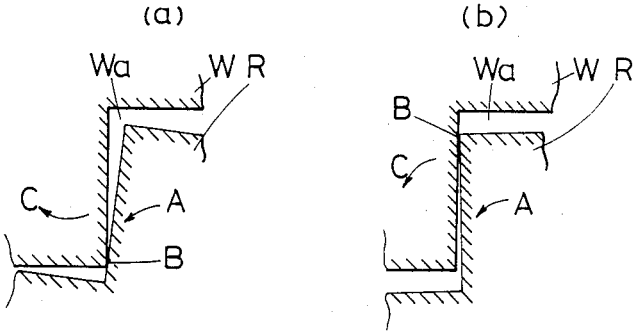
FIGS. 4(*a*) and 4(*b*) are schematic views for explaining the coordinating function between the workpiece and the machining tool.

Therefore, as shown in FIGS. 4(*a*) and 4(*b*), when the work tool R performs the eccentric rotation with a micro-radius counterclockwise as indicated by the arrow A, and in the case where a part of the work tool R does not coordinate with the work portion Wa of the workpiece W but they abut at a point B to each other, the workpiece W is automatically rotated in the direction indicated by the arrow C so that the directions of the work tool R and the work portion Wa of the workpiece W coincide thereby providing an automatic and accurate coordination. Due to this, even in the case where the work tool R is not precisely directed to the work portion Wa of the workpiece W at the initial setting, it is automatically adjusted and the correct coordination can be obtained.

For example, in case of grinding the rectangular groove by using the work tool having the cross section of square shape, the deviation of the work tool in the direction perpendicular to the longitudinal direction of the groove is absorbed since the workpiece moves in a body. Consequently the work tool micro-vibrates in the longitudinal direction of the above groove for the workpiece and at the same time it periodically and vertically moves. Therefore, by moving the workpiece in the longitudinal direction of the groove, the groove is precisely ground by the work tool. When moving the workpiece in the longitudinal direction of the groove, even if the workpiece has been introduced in a direction which will cross the longitudinal direction of the groove, the workpiece is slightly rotated as described before to correctly coordinate the groove with the work tool. In this way, it is possible to perform extremely easily a precise grinding of the work portion of the workpiece.

Figure 5:
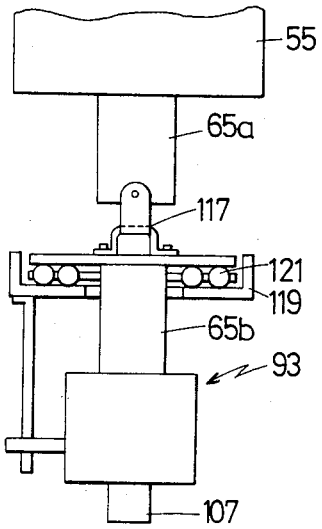
FIG. 5 is a schematic partially sectional view of a spindle for describing another embodiment of the invention.

The above explanation has been made with respect to the case where the workpiece W along with the table in a body moves horizontally and rotates. However, the similar functional effects as described previously can be derived by supporting the work tool so that it can freely move horizontally and slightly rotate. That is to say, for instance, as shown in FIG. 5 the spindle, which can move vertically is divided into the upper spindle 65*a* and a lower spindle 65*b*. These upper and lower spindles 65*a* and 65*b* are coupled with each other through a proper flexible coupling 117 such as a coil spring. The lower spindle 65*b* is mounted to the upper spindle 65*a* such that the lower spindle 65*b* changes its location slightly and can freely twist. The lower spindle 65*b* depends from the arm 45 and is supported through balls 121 by a supporting member 119 which is suitably mounted so as to move vertically so that the lower spindle 65*b* can freely move horizontally and rotates (twists) slightly.

In accordance with this construction, as shown in FIG. 5, since the work tool moves horizontally and rotates slightly to provide the coordination between the work portion of the workpiece and work tool, it is possible to obtain the remarkable work effects even where the weight of the workpiece is very large.

Figure 6:
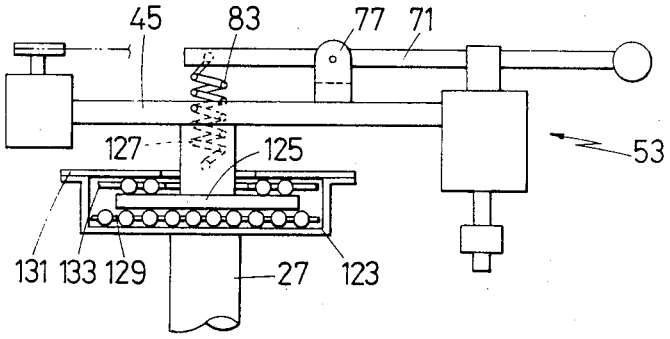
FIG. 6 illustrates a schematic partially sectional view of a supporting rod of further another embodiment of the invention.

Furthermore, such a construction as shown in FIG. 6 is also possible. Namely, a circular concavity member 123 is fixed on the upper portion of the supporting rod 27, and a pole 127 having a disc 125 is vertically mounted in a body downward of the lower portion of the arm 45. A discoidal retainer 129, having a number of balls so as to roll freely, is arranged at the bottom in the concavity member 123. The and the disc 125 is supported on this retainer 129. An annular cover member 131 is fixed in a body above the concavity member 123. An and an annular retainer 133, having a number of balls, is sandwiched between this cover member 131 and the disc 125 so that the arm 45 can freely move in any horizontal direction and rotate, resulting in the same effect as the embodiment described previously. The spring member 83 serves to under load joint the pole 127 and the swinging lever 71.

As understood from the above-described embodiments, according to the present invention, even when the direction of the workpiece and the grinding tool do not coincide correctly, since the workpiece instantly conforms and goes with the deviation of the grinding tool to be automatically corrected, the correct coordination between the grinding tool and the work portion of the workpiece is assured. Thus, it is possible to perform extremely and easily ultra-precision grinding finish-work with high accuracy. Therefore, the initial setting is not always necessary to be done accurately and relatively rough setting may be possible which provides improvements in work efficiency. Moreover, it is possible to adjust the amplitude of the grinding tool according to, for example, the clearance between the work portion of the workpiece and the grinding tool. This provides for precise grinding finish-work under the suitable condition.

Furthermore, since the work tool moves vertically and periodically the cutting ratio (worked area per unit time) is further improved and the work can be done efficiently. In addition, when the workpiece material is largely moved in order to change the work location thereof, by movement of the X and Y table, it is possible to move the workpiece smoothly and to a large degree.

With this detailed description of the specific ultra-precision grinding machine used to illustrate the preferred embodiments of the present invention, it will be obvious to those skilled in the art that various modifications can be made in the present method and apparatus described herein without departing from the spirit and scope of the invention which is limited only by the appended claims.

What is claimed is:

1. An ultra-precision grinding machine comprising: a grinding tool; means for supporting said grinding tool in a selected position; means for revolving said grinding tool; and means for supporting a workpiece to be machined with said grinding tool; said supporting means including an upper plate on which the workpiece may be mounted, and a plate-like floating retainer means having ball bearing means for enabling said upper plate to shift smoothly and swiftly its horizontal position in a plane by a rolling of balls of said ball bearing means responsive to an external force being applied to the workpiece.

2. The ultra-precision grinding machine of claim 1, wherein said supporting means further includes a radial roll bearing provided on a central portion of said upper plate whereby the upper plate may rotate around said roll bearing.

3. The ultra-precision grinding machine of claim 2, wherein said supporting means further includes an intermediate plate on which said floating retainer rides and a lower plate-like floating retainer having a plurality of balls on which said intermediate plate is mounted so as to shift smoothly and swiftly its horizontal position when an external force is applied to the workpiece.

4. The ultra-precision grinding machine of claim 3, wherein said lower retainer is formed with a central circular opening and said intermediate plate is provided with a radial roll bearing which is extended downwardly so as to be positioned into said lower retainer opening.

5. The ultra-precision grinding machine of claim 4, wherein said retainers and plates are disc-shaped.

6. An ultra-precision grinding machine of claim 5, wherein said upper plate is provided with a cylindrical portion which is extended downwardly to cover the periphery of said supporting means.

7. The ultra-precision grinding machine of claim 1, wherein said revolving means comprises: a sleeve adapted to rotate around its central axis and having an eccentric hole, an eccentric disc having an eccentric hole mounted in said disc hole in a manner to adjust the position of said disc eccentric hole with relation to a central axis of said sleeve, a holder for holding said grinding tool mounted in said disc eccentric hole in a freely rotatable manner, said holder being provided with a protrusion; and a cover receiving said holder protrusion so as to prevent rotation of said holder.

8. The ultra-precision grinding machine of claim 7, wherein said sleeve is mounted on the inside of a cover through a ball bearing, and said holder is mounted on the inside of the disc through a ball bearing.

9. An ultra-precision grinding machine for accurately grinding a workpiece, comprising a rotary slide table for receiving the workpiece having a work portion thereon, a grinding tool adapted to be engaged with the work portion of said workpiece and to freely micro-vibrate horizontally; a machining head apparatus disposed upward of said workpiece, for holding said grinding tool; a Y table supporting said slide table, said Y table being provided so as to freely move in the Y-axis; and an X table supporting said Y table, said X table being provided so as to freely move in the X-axis direction.

* * * * *